United States Patent [19]

Kanazawa et al.

[11] Patent Number: 4,727,896

[45] Date of Patent: Mar. 1, 1988

[54] ULTRASONIC WASHING MACHINE FOR TABLEWARE

[75] Inventors: Masao Kanazawa, 6-10, Nakakagaya 4-chome, Suminoe-ku, Osaka; Yukio Ooka, 2-1-708, 1-chome, Minamisakurazuka Toyonaka-shi, Osaka, both of Japan

[73] Assignee: Masao Kanazawa, Osaka, Japan

[21] Appl. No.: 780,080

[22] Filed: Sep. 25, 1985

[51] Int. Cl.[4] ..... B08B 3/12

[52] U.S. Cl. ..... 134/184; 134/102; 366/127

[58] Field of Search ..... 134/1, 25.2, 30, 37, 134/184, 102; 68/3 SS; 366/113, 127

[56] References Cited

U.S. PATENT DOCUMENTS 2,828,231 3/1958 Henery .
2,882,706 4/1959 Brucken ..... 68/3 SS X

FOREIGN PATENT DOCUMENTS 215111 5/1961 Austria ..... 68/3 SS
2907562 8/1980 Fed. Rep. of Germany ..... 68/3 SS

*Primary Examiner*—Timothy F. Simone
*Assistant Examiner*—Frankie L. Stinson
*Attorney, Agent, or Firm*—Wenderoth, Lind & Ponack

[57] ABSTRACT

An ultrasonic washing machine for tableware is provided with an ultrasonic generator and an air bubble supplying device in a tub. Air bubbles are sent out from holes of an air bubble supplying device to reflect ultrasound when ascending in water in the tub. Other air bubbles dissolve in the water, but arise on the tableware again by the cavitation effect of the ultrasound, which makes dirt or alien matters release from the tableware. The air in the water consumed by the cavitation of the ultrasound is fed into the water from outside from time to time. Therefore, cleaning of the tableware by air bubbles is carried out constantly and no detergent is needed in washing the tableware.

6 Claims, 2 Drawing Figures

ULTRASONIC WASHING MACHINE FOR TABLEWARE

BACKGROUND OF THE INVENTION

1. Field of the Invention

This invention relates to a washing machine for tableware. More particularly, this invention relates to a washing machine for tableware provided with an ultrasonic generator and an air bubble supplying device.

2. Description of Related Art

In the machine industry, an ultrasonic washing machine has so far been employed to wash parts of machines. A conventional ultrasonic washing machine has a washing tube to hold a cleaning solution which is replaced with another one according to the parts to be washed. Generally, an ultrasonic generator is installed in the tub. In the case of comparatively small parts, ultrasound hits their surface all around, so that washing is made very well. However, when lots of flat things like plates or dishes are washed, ultrasound is reflected on the nearest object. Consequently, it does not reach the next object behind that one. Therefore, good washing can not always be expected. If, however, ample space is given to plates or dishes in order that ultrasound may strike each of them, a washing tub would be too large to be practical. In view of the above and some other problems, an ultrasonic generator has not been used for washing tableware.

SUMMARY OF THE INVENTION

Accordingly, it is an object of this invention to provide a washing machine for tableware that makes use of ultrasound. It is another object of this invention to provide an ultrasonic washing machine simple in construction and having an excellent capacity for washing tableware. It is still another object of this invention to provide an ultrasonic washing machine which requires no detergent for washing and does not pollute sewerage with its waste detergent solutions. The above and further objects and novel features of this invention will more fully appear from the following detailed description when the same is read in connection with the accompanying drawings. It is to be expressly understood, however, that the drawings are for the purpose of illustration only and are not intended as a definition of the limits of the invention.

DESCRIPTION OF THE PREFERRED EMBODIMENT

Figure 1:
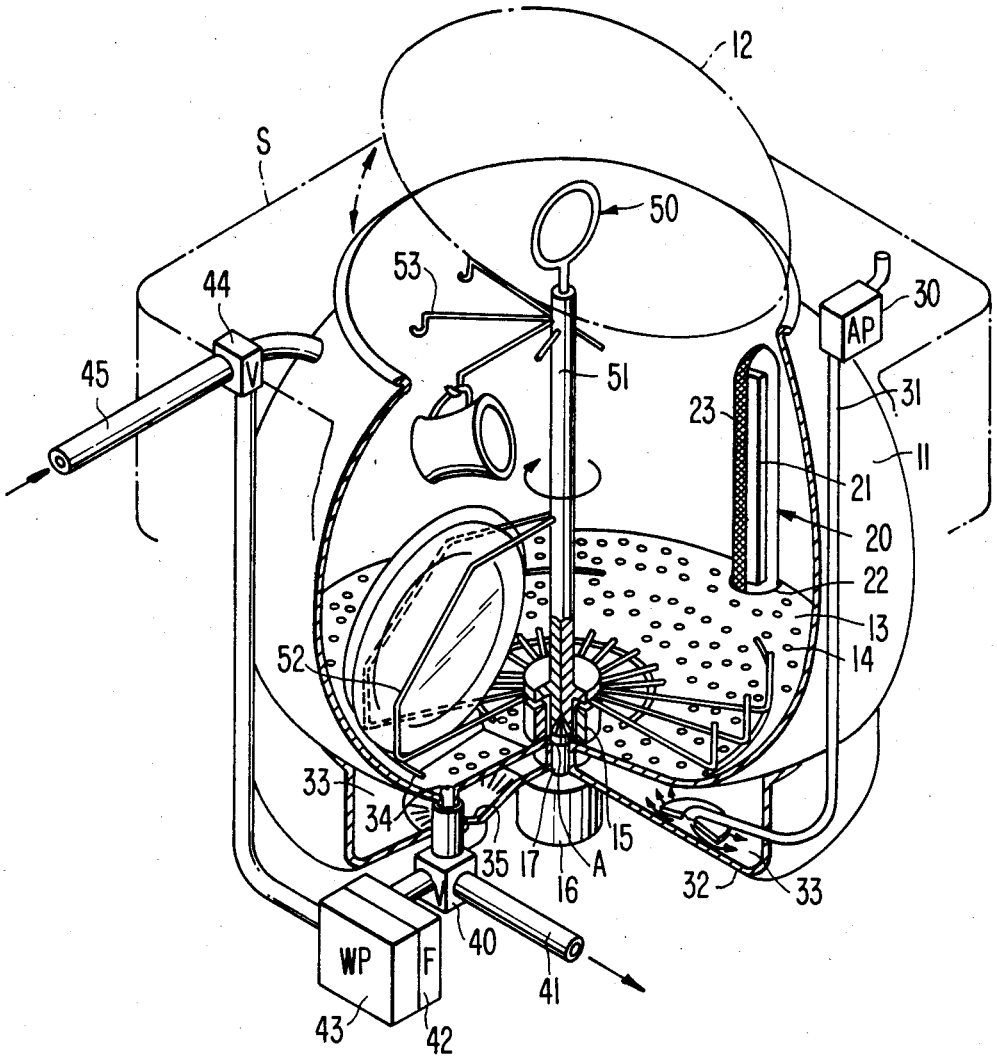
FIG. 1 is a partially cutaway perspective view of an essential part of an ultrasonic washing machine of the present invention.

In FIG. 1, the numeral 11 designates a spherical washing tub having a top end that is opened. A lid 12 made of metal, forming a part of the spherical tub, is provided on the opened top end so as to open or close freely. It is desirable to put a packing or the like on the brim of the metal lid 12 and/or the opening of the tub 11 to make the lid water-tight. In this case, if a hole is made on top of the metal lid to allow the air to pass through, the tub can be charged with water up to the lid and this leads to increasing the availability of the inside space. Also, making the backside of the lid spherical is very helpful to make ultrasound prevail over the tub more uniformly.

Lots of small holes are pierced in the bottom 13 of the tub. An ultrasonic generator 20 is installed on the bottom beside the inner surface of the tub. An oscillator 21 of the ultrasonic generator 20 stands upright on the bottom of the tub; its base is made water-tight by a seal 22. Meantime, a basket 23 having a comparatively coarse mesh covers the oscillator. The frequency of the ultrasonic generator is designed to be variable in the range 15 to 50 KHz so as to accommodate for washing a wide variety of tableware. The oscillator is desirable to have no directivity in view of uniform prevalence of generated ultrasound in the tub. If, however, it has some directivity, a plurality of oscillators should be placed in the tub here and there or a plurality of reflectors should be placed in the tub to reflect the ultrasound. By taking such measures, restrictions on the ultrasonic prevalence coming from the shape and the construction of the tub can be reduced to a great extent.

Originally, the inner surface of the tub is preferable to be metal in order to facilitate reflection of the ultrasound, but in order to prevent corrosion, it may be coated with a synthetic polymer so thin that it does not hinder the reflection. Besides, the tub may be formed into any shape.

Figure 2:
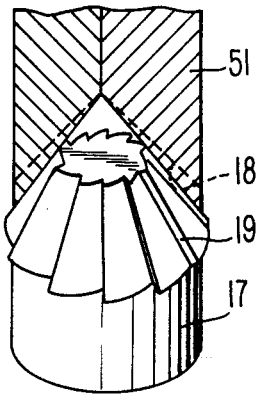
FIG. 2 is an enlarged illustration of part A of the ultrasonic washing machine in FIG. 1.

A dish stand 50 is installed in the middle of the tub 11. A metal spoke 52 is attached to the lower part of a central pole 51 of the dish stand and some hooked rods 53 to hang cups and the like on are attached to the upper part of the central pole radially. The dish stand 50 can be fixed to a thrust bearing 15 provided on the bottom with a flange fastened to the lower end of the pole 51 in such a way that it can rotate freely. A shaft 17 of a motor 16 installed beneath the tub is engaged with the thrust bearing. More particularly, as shown in FIG. 2, the lower end of the pole 51 and the upper end of the motor shaft 17 are engaged with each other by means of radial teeth 18, 19. Therefore, by putting the pole in the thrust bearing, a coupler is formed by which the motor 16 can rotate the pole.

As best seen from the above, the construction makes it very easy to take out washed tableware placed on the dish stand. Additionally, it is very helpful to evenly expose all the tableware to the ultrasound. Consequently, an effective washing can be made without making the tub much larger.

A bubble supplying room 33 is formed between the bottom of the tub 11 and a base plate 32 thereof. An air pump 30 is disposed at the upper part of the outside of the tub. Accordingly, the air is fed into the bubble supplying room 33 by way of a pipe 31. Thus, the air is sent out from the bubble supplying room through lots of holes in the bottom. Incidently, the air may be sent out therefrom through a porous material.

A water outlet 34 on the bottom 13 and a water outlet 35 on the base plate 32 similarly lead to a switch valve 40, where part of spent water is exhausted through a pipe 41 and the rest is allowed to pass through a filter 42 and reach a pump 43 which communicates with a water inlet valve 44. A pipe 45 through which fresh water is supplied is also connected to the valve 44. Since part of spent water is thus made to recirculate for re-use through the outlets 34, 35, the valve 40 and the filter 42 and the spent water contains no detergent at all according to this invention, the water can be recycled and its consumption is greatly reduced.

Working steps in using the ultrasonic washing machine of this invention will be described in detail with reference to the accompanying drawing as follows. To begin with, some water in proportion to the quantity of tableware to be washed is put in the tub 11 through a water inlet pipe 45. At this moment, the valve 40 is closed to the pump 43. Next, some tableware is put in the tub 11. When the dish stand is intended to be used it is taken out of the tub. Dishes are placed on the metal spokes 52, cups are hung on the hooks of the rods 53 and then the pole 51 of the dish stand 50 is put in the thrust bearing 15 so as to engage with the shaft 17 of the motor 16. A selector of the ultrasonic generator 20 is set to a certain frequency depending upon the material of the tableware and then a switch is switched on. The oscillator 21 generates ultrasound, a part of which passes through a protective basket mesh or is diffused by reflection on the mesh and then reaches the tableware; the other part is reflected on the inside of the tub and then reaches the tableware.

During or after the generation of ultrasound, the air pump 30 is started in order to feed the air into the bubble supplying room 33 by way of the pipe 31. The air in the form of bubbles ascends in the water from lots of holes 14 pierced in the bottom of the tub. While ascending in the water, some air bubbles dissolve in it and some get to the surface as they are, giving the generating ultrasound more chance to cause diffused reflection on them so as to uniformly make it prevail over the tub.

As long as the condition is kept, the ultrasound forms bubbles on the tableware by its cavitation effect upon hitting the surface of the tableware and the bubbles make dirt or alien matters release from the tableware. Nevertheless, as long as the cavitation continues, the formation of air bubbles is lessened with the passage of time unless the air dissolving in the water is supplemented because the cavitation would use it up. For this, a good washing could be decreased, especially for some tableware placed in the middle of the tub. However, according to this invention, part of the air bubbles fed from the bubble supplying room dissolves in the water from time to time, so that the new air bubbles are constantly formed by the cavitation but never disappear. Also, the other part of the air bubbles, not dissolving in the water, helps the ultrasound be diffused by reflecting them in a very narrow space between dishes or plates to improve the washing effect greatly. The reflection the air bubbles comes from a large difference in sonic impedance between water and air. Anyway, as long as some air, fed from the bubble supplying room, dissolves in water from time to time, some air bubbles are given birth by the cavitation caused by ultrasound. Thus, dirt or alien matters are removed from the tableware completely.

As apparent from the above, air bubbles can enter the very narrow spaces and reflect the ultrasoound, so that no matter how closely tableware is stacked in the tub, it is cleaned thoroughly. Since tableware can be packed so closely, the tub is made small in size and its cost can be reduced in accordance.

When washing comes to an end, the ultrasonic generator 20 and the air pump 30 are stopped and then the valve 40 is switched to the pipe 41 in order to exhaust waste water in the tub and the bubble supplying room 33; in this way, washing is finished. If rinsing is made after the washing, cleaning tableware on the dish stand will become more perfect.

As seen from the above, the ultrasonic washing machine does not need any detergent at all. Therefore, it is not only economical but also causes no environmental pollution problems due to a detergent-containing waste water. Moreover, as long as this ultrasonic washing machine is used, the hardness or the temperature of water does not matter. Accordingly, washing is not affected by the water itself.

When the next washing is desired without exhausting spent water, the valve 40 is switched to the pump 43 and then said pump is started. At this time, the spent water is allowed to pass through the filter 42 and made clean. After cleaned, the water is fed back into the tub by way of the pump 43 and the valve 44. Therefore, if only a spent filter is periodically replaced with a new one, the water can be recycled for extra use such as rinsing, etc., so that an additional merit would be welcomed by those who live in a district short of water or those who use a large amount of water at a time, for example.

What is claimed is:

1. An ultrasonic washing machine for washing tableware and the like, said washing machine comprising:

a metal tub in which the tableware is placed to be washed, said metal tub having a bottom, and fluid inlet means through which water is suppled to said metal tub;

an ultrasonic generator within said tub for generating ultrasound in the water supplied to said metal tub through said fluid inlet means, said metal tub being substantially spherical for reflecting ultrasound generated by said ultrasonic generator to diffuse the ultrasound through said tub onto the tableware; and bubble supplying means at the bottom of said tub for supplying and dispersing bubbles throughout the water supplied to said tub some of which dissolve in the water to replace air that has been removed from the water due to cavitation when said ultrasonic generator generates ultrasound and the remainder of which also reflect the ultrasound to diffuse the ultrasound throughout said tub and onto the articles to be washed in said tub.

2. An ultrasonic washing machine as claimed in claim 1, wherein said ultrasonic generator is variable to generate ultrasound having an ultrasonic frequency between 15 KHz and 50 KHz.

3. An ultrasonic washing machine as claimed in claim 1, wherein said ultrasonic generator comprises a rod-like oscillator extending in a longitudinal direction within said tub, and the bottom of said tub comprises a perforated plate; and said bubble supplying means comprises a chamber disposed below said bottom of said tub, an air pump connected to said chamber for supplying air thereto, and said perforated plate through which the air passes to form said bubbles.

4. An ultrasonic washing machine as claimed in claim 1, and further comprising a dishstand within said tub for supporting the tableware within said tub.

5. An ultrasonic washing machine as claimed in claim 4, and further comprising a motor, and a driving shaft rotatably mounted at the bottom of said tub and operatively connected to said motor to be rotated thereby; and said dishstand is removable from said tub, said dishstand having an engaging element detachably mounted on said driving shaft for being rotated thereby.

6. An ultrasonic washing machine as claimed in claim 5, wherein said driving shaft has a plurality of teeth thereon; and said engaging means comprises teeth that engage said teeth of said driving shaft.

* * * * *